US006047427A

United States Patent [19]

Whitlock, Jr. et al.

[11] Patent Number: 6,047,427

[45] Date of Patent: Apr. 11, 2000

[54] RETRACTABLE BLADE HATCHET

[76] Inventors: Vernon J. Whitlock, Jr., 2225 NW. 14th, Oklahoma, Okla. 73107; Johnny L. Mays, 2701 SW. 68th, Oklahoma City, Okla. 73159

[21] Appl. No.: 09/122,747

[22] Filed: Jul. 27, 1998

[51] Int. Cl.[7] ..... B25D 1/04

[52] U.S. Cl. ..... 7/144; 7/158

[58] Field of Search ..... 7/122, 144, 145, 7/158

[56] References Cited

U.S. PATENT DOCUMENTS 1,572,898 2/1926 Martin ..... 7/144
2,500,629 3/1950 Crookston ..... 7/145
2,729,889 1/1956 Trinski ..... 7/145
3,233,643 2/1966 Reuterfors ..... 7/144

*Primary Examiner*—James G. Smith
*Assistant Examiner*—David B. Thomas

[57] ABSTRACT

A roofer's composition roof shingling hammer is formed by eliminating the typical sharpened cutting edge of the metal head and forming a longitudinal groove in the straight peen normal to the longitudinal axis of the hatchet handle. A flat blade, having sharpened end portions, is longitudinally slidable into and out of the groove. Pivoting lever and link means mounted on the metal head move the blade out of the straight peen groove in a direction opposite the nail hammering face for cutting a roof shingle, and withdraws the blade into the confines of the groove when not in use.

6 Claims, 1 Drawing Sheet

RETRACTABLE BLADE HATCHET

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to hand tools and more particularly to a retractable blade roofer's hatchet.

1. Field of the Invention

Hatchets used for installing composition roof shingles have generally comprised a cutting edge or blade portion opposite the face of a nail striking hammer head. This blade is necessarily provided with a sharp edge for cutting shingles in the installation of a composition shingle roof. This sharp blade poses a safety hazard during roofing work, some times resulting in accidentally cutting fingers or hands. This invention is believed to obviate the need for an exposed blade on a roofing hatchet by providing a retractable blade which is manually spring biased outward from the hatchet cutting edge for a cutting action and when released is slidably retracted within a channel-like groove in an out-of-the-way position, as will be more fully explained hereinbelow.

2. Description of the Prior Art

We are not aware of any patent or publication which discloses our invention.

BRIEF SUMMARY OF THE INVENTION

The straight peen portion of a hammer is provided with an elongated laterally open box channel, in transverse section, groove orthogonally disposed with respect to the longitudinal axis of the hammer handle which slidably receives a blade having a sharp edge. An auxiliary or blade handle pivotally connected with the metal head is pivotally connected by a link with the slidable blade for extending the blade outwardly of the straight peen for a shingle cutting action and retracting the blade within the confines of the groove and straight peen by a spring interposed between the blade handle and the hammer handle.

DETAILED DESCRIPTION OF THE INVENTION

Figure 3:
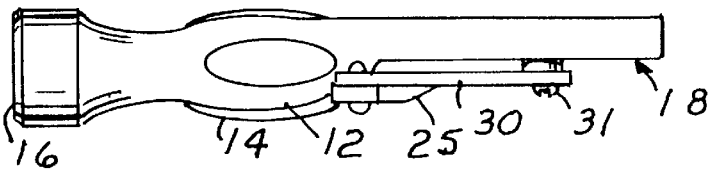
FIG. 3 is a top view.
Figure 1:
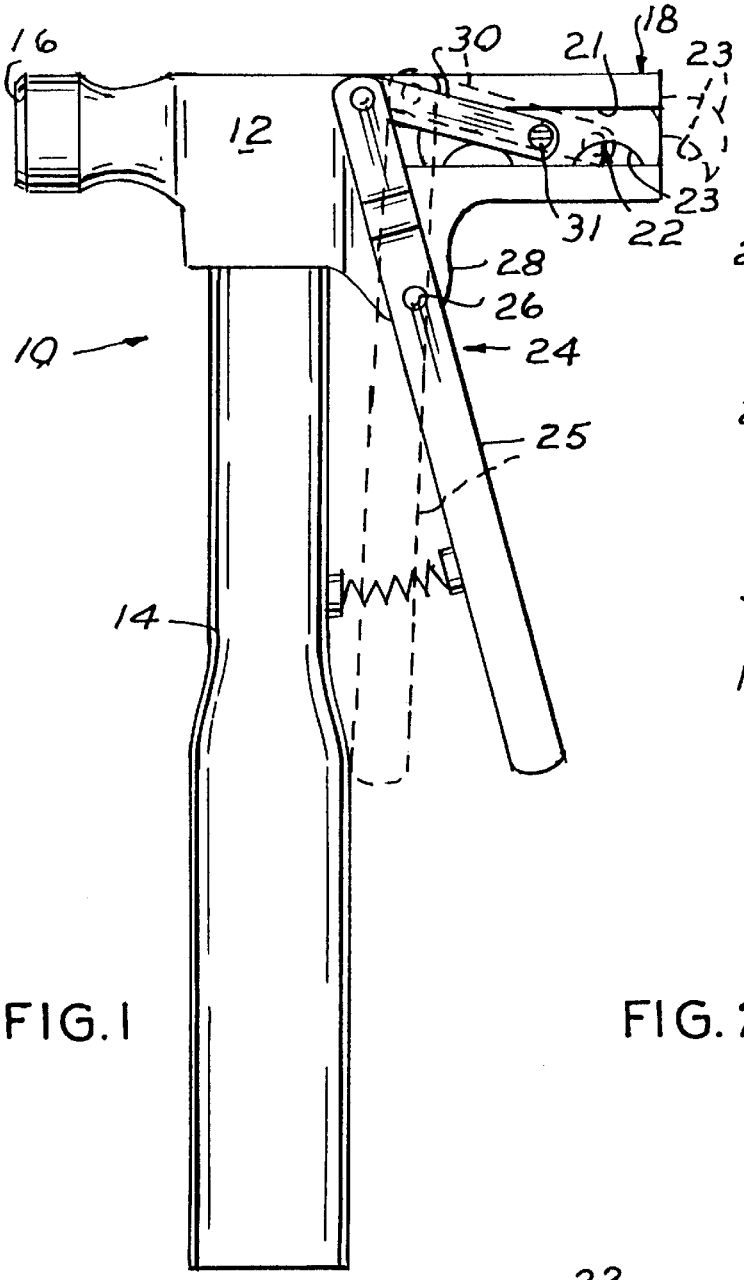
FIG. 1 is a side elevational view illustrating by dotted lines the blade extension action.
Figure 2:
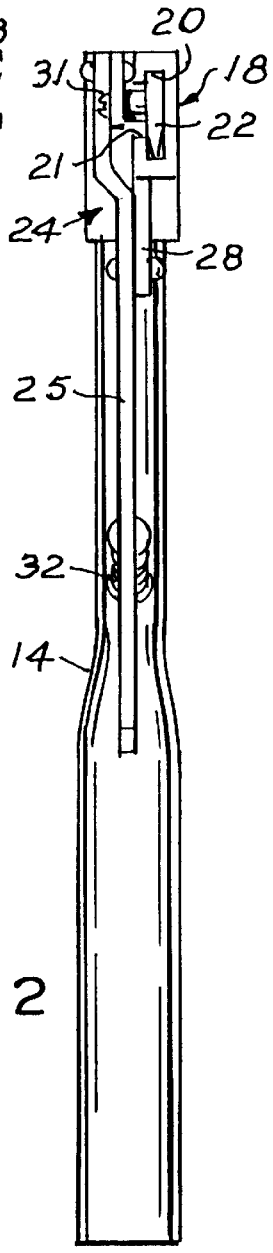
FIG. 2 is a right side elevational view.
Figure 4:
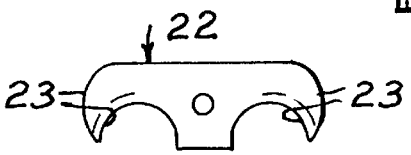
FIG. 4 is an elevational view of the double end cutting blade.

Like characters of reference designate like parts in those figures of the drawings in which they occur.

In the drawings:

The reference numeral 10 indicates the hatchet as whole having a metal head 12 transversely secured to one end of an elongated handle 14. The metal head is provided with a nail hammering face 16 and an opposite straight peen blade-like portion 18 normal to the longitudinal axis of the handle. The peen portion 18 is provided with an elongated substantially box shaped, in transverse section, groove 20, having a coextensive lateral opening 21, orthogonally disposed with respect to the longitudinal axis of the hatchet handle 14. The groove 20 slidably receives blade means 22 having opposite, preferably arcuate edges forming hook-shaped, sharpened end portions 23 for to and fro movement in the groove and beyond the end surface of the straight peen opposite the nail hammering face. Obviously the blade may be formed straight or with other shaped cutting edges, if desired.

A lever means 24, including a lever 25, is pivotally connected, as at 26, with a lateral extension 28 of the straight peen for pivoting movement of the end portions of the lever toward and away from the axis of the handle 14. One end portion of the lever is pivotally connected with one end portion of a link 30 in-turn pivotally connected at its other end portion with the blade means 22 intermediate its ends by a screw 31.

Resilient means such as a spring 32 is interposed between the handle 14, intermediate its ends, and the end portion of the lever 25 opposite the link 30 to normally bias the lever end portion opposite the link laterally of the handle 14 and retract the blade 22 into the groove 20.

OPERATION

The blade is normally maintained retracted within the groove 20. When it is desired to use the blade means 22 the lever 25 is manually grasped by the user when gripping the handle 14 to force the lever toward the handle and extend the blade means 22 out of the groove 20 which positions one end of the blade for a cutting action on a composition roof shingle, not shown. Releasing the lever 25 allows the spring 32 to retract the blade into the groove 20.

Obviously the invention is susceptible to changes or alterations without defeating its practicability. Therefore, we do not wish to be confined to the preferred embodiment shown in the drawings and described herein.

We claim:

1. In a composition shingle roofing tool having a metal head at one end of an elongated handle and having a straight peen opposite a nail hammering face, the improvement comprising:

said straight peen having opposite side surfaces and having an elongated channel-like groove in one said side surface orthogonally disposed with respect to the longitudinal axis of said handle;

an elongated blade having a sharpened cutting edge at its respective ends longitudinally slidable in the groove;

an elongated lever pivotally connected intermediate its ends with said metal head for pivoting movement of one end portion of the lever toward and away from the handle;

a link extending between and pivotally connected at its respective end portions with said blade intermediate its ends and the other end portion of said lever for disposing a cutting edge of said blade beyond the cutting edge opposite said nail hammering face; and, resilient means interposed between said handle and the lever means for normally biasing said blade means into the groove.

2. In a composition shingle roofing tool having a metal head at one end of an elongated handle and having a straight peen opposite a nail hammering face, the improvement comprising:

said straight peen having opposite side surfaces and having an elongated channel-like groove in one said side surface orthogonally disposed with respect to the longitudinal axis of said handle;

cutting blade means longitudinally slidable in the groove;

lever means pivotally supported by said head and connected with said blade means for moving said blade into and out of the groove; and, resilient means interposed between said handle and the lever means for normally biasing said lever away from said tool handle.

3. The combination according to claim 2 in which the cutting blade means comprises;

a generally rectangular planar blade having opposing sharpened end portions.

4. The combination according to claim 3 in which the sharpened opposing end portions of said blade substantially define a hook-shape.

5. The combination according to claim 4 in which the hook is open toward the end of the handle opposite the metal head.

6. The combination according to claim 3 in which the lever means comprises:

an elongated lever pivotally connected intermediate its ends with said metal head for pivoting movement of one end portion of the lever toward and away from the handle; and, a link extending between and pivotally connected at its respective end portions with said blade medially its ends and the other end portion of said lever for disposing a hook-shaped end of said blade beyond the cutting edge opposite said nail hammering face.

* * * * *